US010682567B1

(12) United States Patent
Jezin

(10) Patent No.: US 10,682,567 B1
(45) Date of Patent: Jun. 16, 2020

(54) AUTOMATED ROULETTE SYSTEM

(71) Applicant: Anthony Jezin, San Pedro, CA (US)

(72) Inventor: Anthony Jezin, San Pedro, CA (US)

( * ) Notice: Subject to any disclaimer, the term of this patent is extended or adjusted under 35 U.S.C. 154(b) by 0 days.

(21) Appl. No.: 16/032,540

(22) Filed: Jul. 11, 2018

(51) Int. Cl.
*A63F 5/00* (2006.01)
*G07F 17/32* (2006.01)

(52) U.S. Cl.
CPC ..... *A63F 5/0005* (2013.01); *A63F 5/0082* (2013.01); *G07F 17/3216* (2013.01); *G07F 17/3223* (2013.01)

(58) Field of Classification Search
USPC ..... 463/17
See application file for complete search history.

(56) References Cited

U.S. PATENT DOCUMENTS 175,840 A 4/1876 Pepper
6,520,854 B1 * 2/2003 McNally ..... A63F 5/00 273/142 B
7,946,912 B1 * 5/2011 Rennard ..... A63F 5/00 273/138.1
2004/0072609 A1 * 4/2004 Ungaro ..... G07F 17/322 463/17
2010/0120488 A1 * 5/2010 Savytskyy ..... G07F 17/32 463/17

* cited by examiner

*Primary Examiner* — Pierre E Elisca
(74) *Attorney, Agent, or Firm* — Sanchelima & Associates, P.A.; Christian Sanchelima, Esq.; Jesus Sanchelima, Esq.

(57) ABSTRACT

The present invention is directed to an automated roulette system that does not require any human operator or dealer to execute the game. The automated roulette system comprises a roulette wheel that is provided with means to automatically eject three roulette balls onto a wheelhead of the roulette wheel after receiving instructions from a user. The automated roulette system is also provided with a bill receiving module for allowing the user to deposit the funds required for a bet; a betting module for allowing the user to select a bet of their choosing; a payout identification module for computing the payout after a game has been played; and a token generation module to generate a token corresponding to the payout, which can be encashed by the user.

4 Claims, 3 Drawing Sheets

AUTOMATED ROULETTE SYSTEM

II. BACKGROUND OF THE INVENTION

1. Field of the Invention

The present disclosure relates to a gaining and betting machine, typically employed in casino-like setups. More particularly, the present disclosure relates to an automated roulette system that requires no human operator or dealer.

2. Description of the Related Art

Typical roulette machines allow a user to place bets in predicting where, on the roulette wheel, will the ball land. The ball is typically released in a direction opposite to the direction of rotation of the roulette wheel. In each game, the dealer is required to place the user's bets and identify the payout, while also having the expertise to skillfully release the ball on the roulette wheel for each game. The presence of the dealer is essential in the conventional roulette machines for executing the entire game. This is not desired. There is, therefore, felt a need for a fully automated roulette system, which can be easily used by the users for placing their bets.

Several designs for roulette gaining machines have been designed in the past. None of them, however, have been designed to be fully automated such that the need for a human operator or dealer to assist the users in their gambling endeavors is completely eliminated.

Applicant believes that a related reference corresponds to US Patent Publication no. US20120175840 filed by Joseph Zerga for a roulette wheel having reduced bias. The Zerga reference discloses a roulette wheel that includes a central spindle, a wheelhead and turret unit freely rotatable around the central spindle, a cone freely rotatable around the central spindle independently of the wheelhead and turret unit, and a lower ball track. However, the roulette wheel disclosed in the Zerga reference, fails to disclose any kind of mechanism for automatically releasing the ball onto the roulette wheel and for automatically identifying the payouts.

Another related application is U.S. Pat. No. 7,946,912 filed by Carl J Rennard for a roulette system. The Rennard reference discloses a roulette system for games, wherein a projection system, preferably with a laser, is utilized for illuminating selected areas of the roulette game table in order to highlight the winning bets. However, the roulette system disclosed in the Zerga reference fails to disclose any kind of mechanism for automatically releasing the ball onto the roulette wheel and for automatically identifying the payouts.

Other documents describing the closest subject matter provide for a number of more or less complicated features that fail to solve the problem in an efficient and economical way. None of these patents suggest the novel features of the present invention.

III. SUMMARY OF THE INVENTION

It is an object of the present invention to provide an automated roulette system, in which the need for having a human dealer is eliminated.

It is still another object of the present invention to provide an automated roulette system having a provision for automatically releasing three roulette balls onto the roulette wheel at a time, thereby greatly increasing the betting options available to a user.

Further objects of the invention will be brought out in the following part of the specification, wherein detailed description is for the purpose of fully disclosing the invention without placing any limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric view of a roulette wheel 10 for an automated roulette system, in accordance with one embodiment of the present invention, which comprises a wheelhead 12, and openings 14 provided on the periphery of the wheel head 12 for allowing the ejection of the roulette balls onto the wheelhead 12.

V. DETAILED DESCRIPTION OF THE EMBODIMENTS OF THE INVENTION

Figure 1:
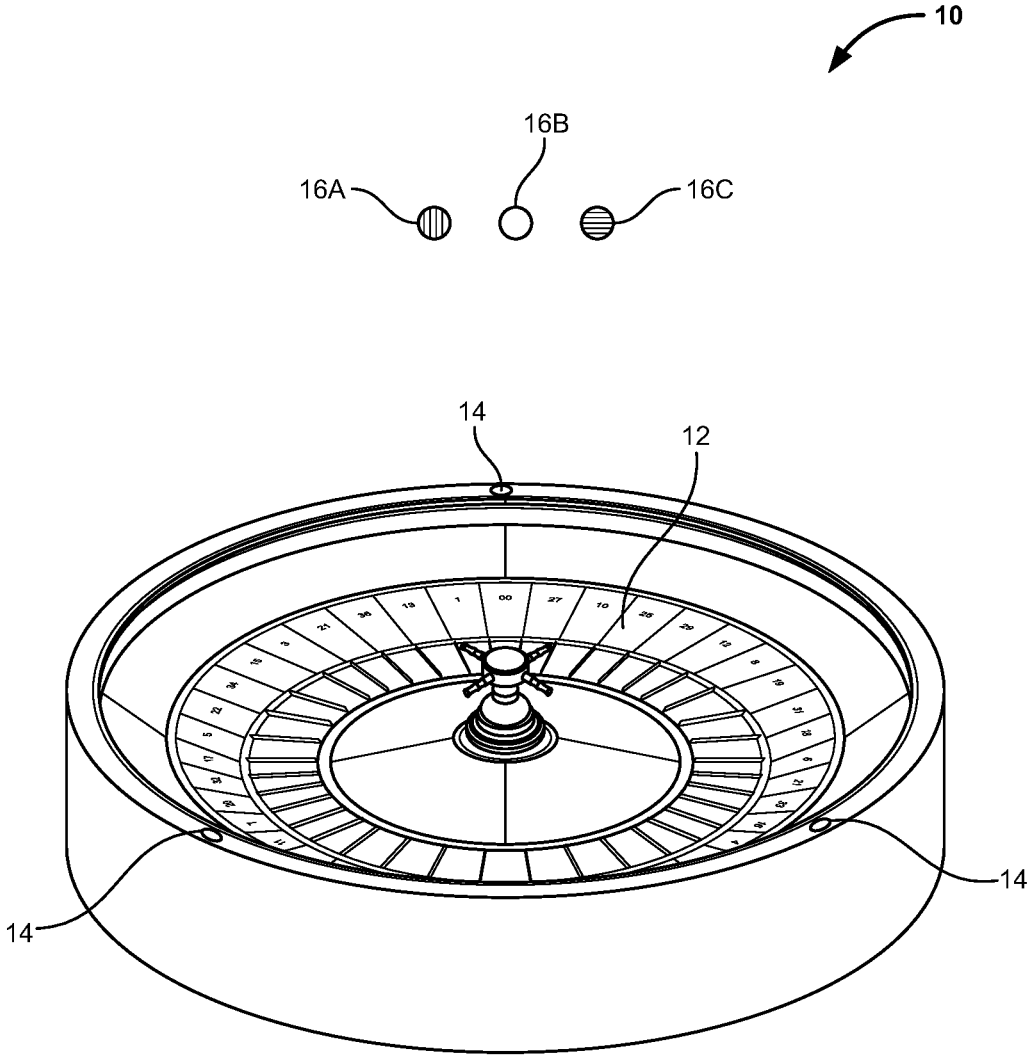
Figure 2:
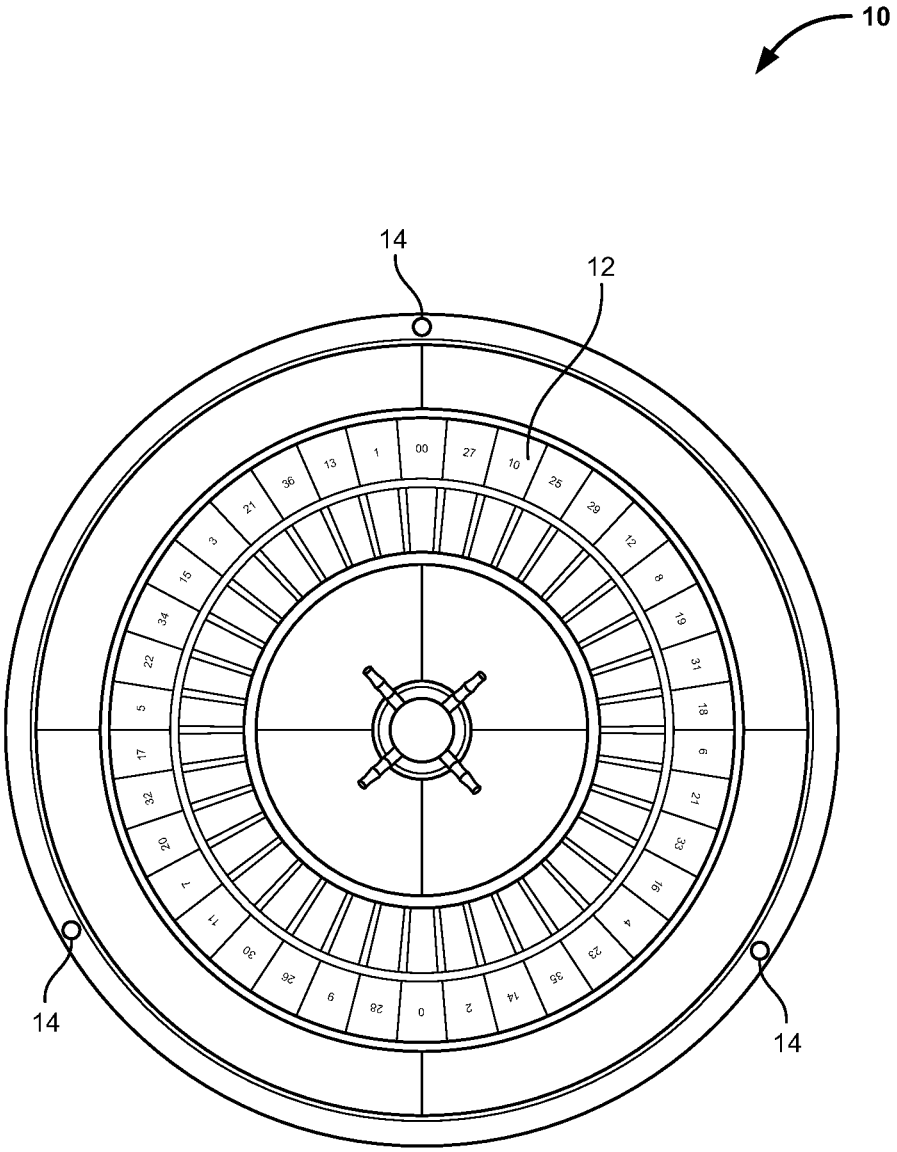
FIG. 2 represents a top view of the roulette wheel 10, as illustrated in FIG. 1.

Referring to FIG. 1 and FIG. 2, where the roulette wheel, in accordance with the present invention, is referenced by the numeral 10. The roulette wheel 10 is part of an automated roulette system, which has been referenced by the numeral 20 in FIG. 3. The roulette wheel 10 comprises a wheelhead 12. The wheelhead 12 of the roulette wheel 10 is the wheel with the appropriate numerals provided thereon with appropriately colored backgrounds. The wheelhead 12 can be rotatable in one embodiment. In this embodiment, the roulette wheel further comprises a motor (not shown in figures) provided for facilitating the rotation of the wheelhead 12.

The roulette wheel 10, in accordance with the present invention, has three apertures 14 provided at equidistant locations along a periphery of the wheelhead 12. More specifically, the apertures 14 are provided at angular intervals of 120° along the periphery of the wheelhead 12. The three apertures 14 are provided on the wheelhead 12 for allowing introduction of three roulette balls 16A, 16B, 16C. The wheelhead 12 is provided with an ejection means (not shown in figures) for ejecting the roulette balls 16A, 16B, 16C from the apertures 14. Furthermore, in one embodiment, means can be provided on the roulette wheel 10 for automatically collecting the roulette balls from the wheelhead 12 after the completion of a game.

In accordance with the present invention, the balls 16A, 16B, 16C are of different colors, which substantially increase the number of betting options available to the users. In one embodiment, the ball 16A is red in color, the ball 16B is white in color, and the ball 16C is blue in color. Some exemplary betting options are described in the subsequent sections of the present disclosure. In accordance with the present invention, the wheelhead 12 and the balls 16A, 16B, 16C are provided with at least one sensor and at least one transceiver, wherein the sensors allow the detection of the presence of the balls 16A, 16B, 16C at the exact locations on the wheelhead 12. The transceivers allow the transmission of the signals associated with the exact location of the balls 16A, 16B, 16C on the wheelhead 12 to a processor 30 which forms the part of the roulette system 20, as illustrated in FIG. 3.

Figure 3:
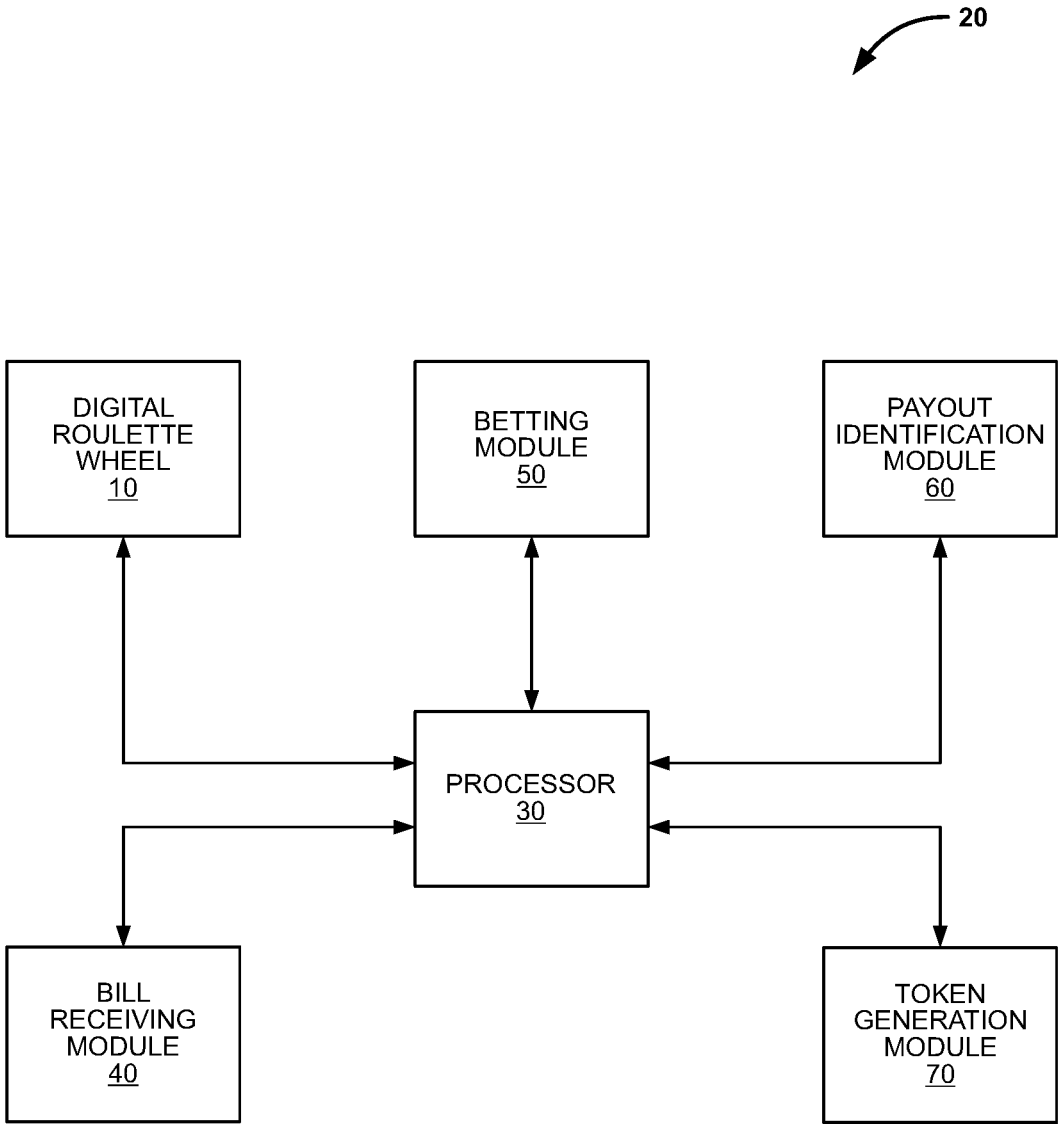
FIG. 3 represents a block diagram for an automated roulette system 20, in accordance with one embodiment of the present invention.

As illustrated in FIG. 3, the roulette system 20 comprises roulette wheel 10, the processor 30, a bill receiving module 40, a betting module 50, a payout identification module 60, and a token generation module 70.

The bill receiving module 40 is in data communication with the processor 30. The bill receiving module 40 is configured to receive currency bills from a user in accordance with the betting option selected by the user. The bill receiving module 40 is configured to count the amount of money deposited by the user in the bill receiving module 40 and send a corresponding signal to the processor 30.

The user can select a desired betting option from the list of betting options available at the betting module 50. In an embodiment, the betting module 50 includes a repository of the betting options which are displayed to a user on a screen. In one embodiment, the betting module 50 includes a touch screen display to allow the user to make the desired selection. In another embodiment, the betting module 50 is provided a screen and an interaction means such as a keypad for allowing the user to interact with the betting module 50.

Some options of the betting options available to the user are described hereinafter:

i. Straight bet—Any single ball on any number; payoff being 35-1.

ii. Exacta—Play 2 balls, e.g., a red ball on any black number and a white ball on any red number; payoff being 3-1. Other option in exacta is to play just one number with a red ball and another number with the white or the blue ball, wherein on landing the correct numbers, the payoff will be 1000-1. Other such options are well within the ambit of the present invention.

iii. Trifecta—Play 3 balls, e.g., red ball on first twelve numbers, white ball second twelve numbers, and blue ball on the third twelve numbers, with the payoff being 26-1, when all the balls land on the betted numbers. The payoff can increase to 10000-1, if the betting is done for each ball to land on a pre-determined number from the first, second, and the third twelve numbers.

iv. Two spin parley—Picking any amount of numbers with any color ball from the previous spin to the next spin. More specifically, one can play all the three balls on any combination of numbers to match the same with the next spin.

v. Three spin parley—Pick any colors of ball on set numbers, e.g., red ball on first twelve numbers, white ball on the second twelve numbers, and the blue ball on the third twelve numbers. If the balls land on the correct sections after three spins, the payoff will be 26-1.

The aforementioned are just some examples of the betting options available to the user on the betting module 50. The betting module 50 is in data communication with the processor 30. The betting module 50 communicates to the processor 30 the desired betting option selected by the user, subsequent to which the processor 30 checks from the previous communication with the bill receiving module 40 on whether the user has deposited enough funds to make the selected bet that was selected on the betting module 50 by the user.

After the game is played where the wheelhead 12 is rotated by the motor (not shown in figure) and the balls 16A, 16B, 16C are ejected from the apertures 14, the exact locations of the balls 16A, 16B, 16C are communicated to the processor 30 via the transceivers installed in the balls 16A, 16B, 16C and the wheelhead 12. This information is then fed to the payout identification module 60, which then proceeds to compute the exact payout attributed to the user. Once the payout is computed, the same is communicated to the processor 30, which then instructs the token generation module 70 to generate an appropriate token corresponding to the payout.

If the user has won the bet, the payout identification module 60 computes the amount won by the user based on which the token is generated by the token generation module 70. The token can then be cashed at the cash counter of the casino like setup where the roulette system 20 has been installed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An automated roulette wheel comprising:

a. a wheelhead with indicia provided thereon;

b. a plurality of apertures provided on the periphery of the wheelhead to introduce a plurality of roulette balls on the wheelhead;

c. at least one sensor coupled with the wheelhead to identify locations of the plurality of roulette balls thereon; and d. a transceiver for communicating the locations of the plurality of roulette balls to a processor.

2. The automated roulette wheel of claim 1, wherein the plurality of apertures include three apertures configured at an angular interval of 120° along the periphery of the wheelhead.

3. The automated roulette wheel of claim 1, further comprising ejecting means configured for automatically introducing the roulette balls onto the wheelhead from the plurality of apertures.

4. The automated roulette wheel of claim 1, wherein the at least one sensor is a proximity sensor.

* * * * *